US006860481B2

(12) United States Patent
Chiasson et al.

(10) Patent No.: US 6,860,481 B2
(45) Date of Patent: Mar. 1, 2005

(54) SHEET STACKING DEVICE

(75) Inventors: Maurice Chiasson, Nashua, NH (US); Stephen Copley, Windham, NH (US); Albert Burgun, Meredith, NH (US)

(73) Assignee: Nikko Materials USA, Inc., Chandler, AZ (US)

( * ) Notice: Subject to any disclaimer, the term of this patent is extended or adjusted under 35 U.S.C. 154(b) by 56 days.

(21) Appl. No.: 10/294,292

(22) Filed: Nov. 14, 2002

(65) Prior Publication Data

US 2004/0094890 A1 May 20, 2004

(51) Int. Cl.[7] ..... B65H 29/34
(52) U.S. Cl. ..... 271/189; 271/218
(58) Field of Search ..... 271/189, 218

(56) References Cited

U.S. PATENT DOCUMENTS

| | | | | |
|---|---|---|---|---|
| 726,161 A | | 4/1903 | Harris | |
| 2,323,174 A | | 6/1943 | Wikle | 271/75 |
| 2,325,919 A | | 8/1943 | Porch | 198/65 |
| 2,575,426 A | | 11/1951 | Parnell | 99/154 |
| 3,346,128 A | | 10/1967 | Hullhorst | 214/6 |
| 3,358,853 A | * | 12/1967 | Lucius et al. | 414/788.4 |
| 3,685,636 A | | 8/1972 | Putin | 198/127 |
| 3,717,249 A | | 2/1973 | Faley | 209/75 |
| 3,768,807 A | | 10/1973 | Spengler | 271/190 |
| 3,807,553 A | | 4/1974 | Billett et al. | 209/74 |
| 3,894,638 A | | 7/1975 | Hovekamp | 214/6 |
| 4,055,257 A | | 10/1977 | Krebs | 214/6 |
| 4,159,108 A | | 6/1979 | Haft | 271/190 |
| 4,460,169 A | * | 7/1984 | Bartesaghi | 271/192 |
| 4,469,321 A | * | 9/1984 | Geschwindner | 271/183 |
| 4,856,263 A | | 8/1989 | Schneider et al. | 53/543 |
| 5,284,252 A | | 2/1994 | Bonnet | 209/552 |
| 5,360,100 A | | 11/1994 | Bourgeois | 198/790 |
| 5,435,541 A | * | 7/1995 | Fornay et al. | 271/189 |
| 6,000,695 A | * | 12/1999 | Mack et al. | 271/303 |
| 6,341,698 B1 | | 1/2002 | Wursthorn | 209/552 |

FOREIGN PATENT DOCUMENTS

JP 1-187166 * 7/1989 ..... B65H/29/40

* cited by examiner

*Primary Examiner*—Donald P. Walsh
*Assistant Examiner*—Kenneth W Bower
(74) *Attorney, Agent, or Firm*—Kusner & Jaffe

(57) ABSTRACT

A sheet stacking device for stacking sheets of generally rigid material, comprised of at least one gripper device operable to releasably grip an edge of a sheet material and gripper drive means operable to move the gripper device from a first location to a second location. A support device supports the sheet as the sheet moves from the first location to the second location. The support device has a supporting position, wherein the support device supports the sheet and a non-supporting position wherein support for the sheet is removed. A stacking platform is provided below the second location. Control means control the gripper device, the gripper drive means and the support device. The control means causes the gripper device to grip an edge of the sheet at the first location, the drive means to move the gripper device from the first location to the second location, the gripper device to release the sheet at the second location, and the support device to move from the supporting position to the non-supporting position, dropping the sheet onto the stacking platform.

11 Claims, 9 Drawing Sheets

SHEET STACKING DEVICE

FIELD OF THE INVENTION

The present invention relates to a stacking device, and more particularly, to a stacking device for stacking sheet material. The present invention is particularly applicable for stacking cut-to-length sheets from a generally continuous source, and shall be described with particular reference thereto. It will, of course, be appreciated that the present invention has other broader applications and may be used in stacking other types of sheet material.

BACKGROUND OF THE INVENTION

Many types of sheet material are produced by a process wherein individual sheets are cut from a generally continuous strip or web of material. It is often necessary to stack these "cut-to-length sheets" for packaging and/or shipping. In the process of stacking and/or shipping these "cut-to-length sheets," it is sometimes desirable to minimize the contact between the sheets and the stacking device so as not to damage the sheets.

The present invention provides a device for stacking sheet material, such as cut-to-length sheets that are cut from a generally continuous source.

SUMMARY OF THE INVENTION

In accordance with a preferred embodiment of the present invention, there is provided a sheet stacking device for stacking sheets of generally rigid material, comprised of at least one gripper device operable to releasably grip an edge of a sheet material and gripper drive means operable to move the gripper device from a first location to a second location. A support device supports the sheet as the sheet moves from the first location to the second location, the support device has a supporting position, wherein the support device supports the sheet and a non-supporting position wherein support for the sheet is removed. A stacking platform is provided below the second location. Control means control the gripper device, the gripper drive means and the support device. The control means causes the gripper device to grip an edge of the sheet at the first location, the drive means to move the gripper device from the first location to the second location, the gripper device to release the sheet at the second location, and the support device to move from the supporting position to the non-supporting position, dropping the sheet onto the stacking platform.

It is an object of the present invention to provide a stacking device for stacking sheet material.

It is another object of the present invention to provide a stacking device for stacking "cut-to-length sheets" from a generally continuous source of sheet material.

It is another object of the present invention to provide a stacking device as described above that is adjustable to accommodate sheets of different lengths and widths.

It is a still further object of the present invention to provide a stacking device as described above that diverts cut-to-length sheets with defects from the stacking operation.

It is a still further object of the present invention to provide a stacking device that minimizes contact with the sheet material to be stacked.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
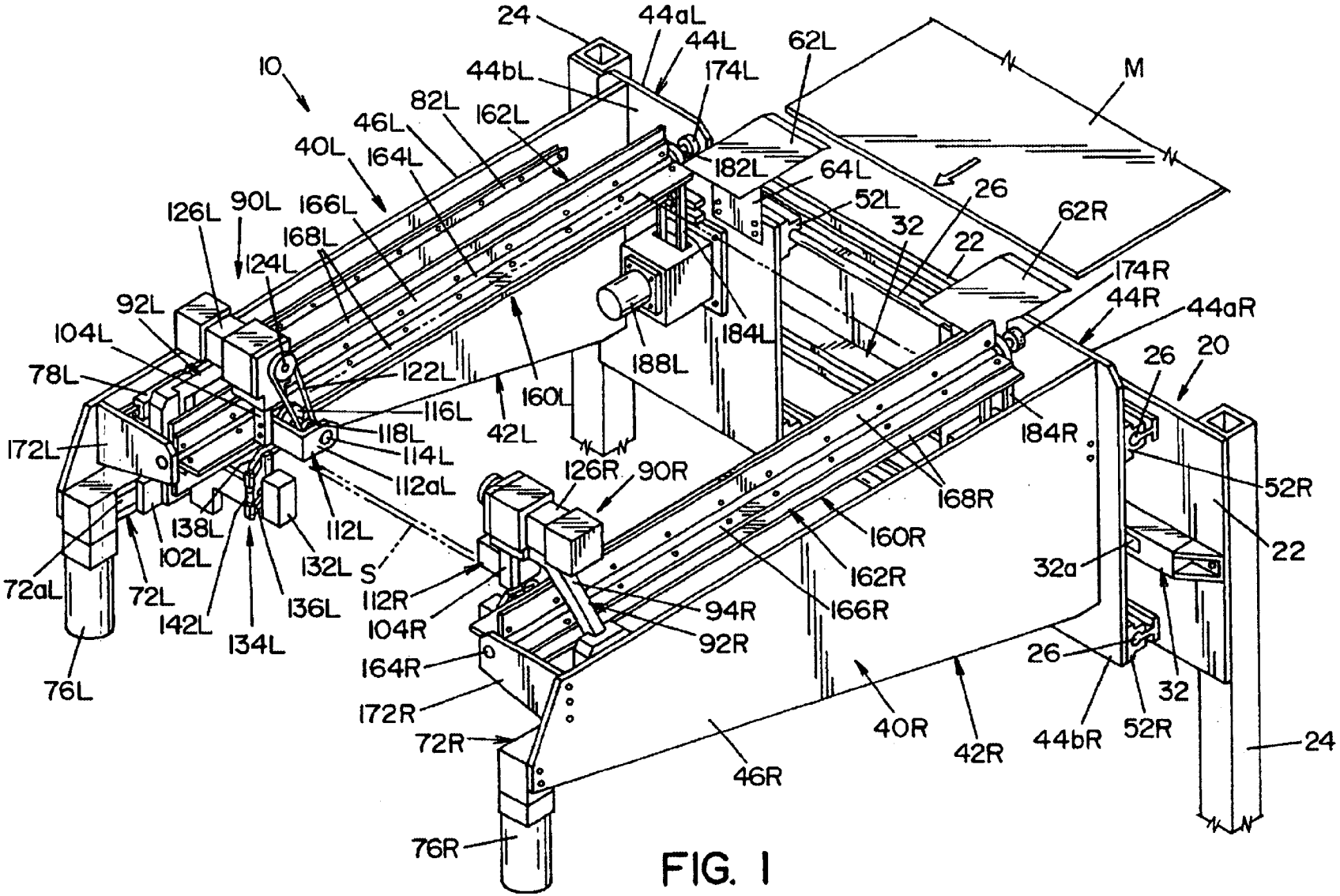
FIG. 1 is a perspective view of a sheet stacking device, illustrating a preferred embodiment of the present invention.
Figure 2:
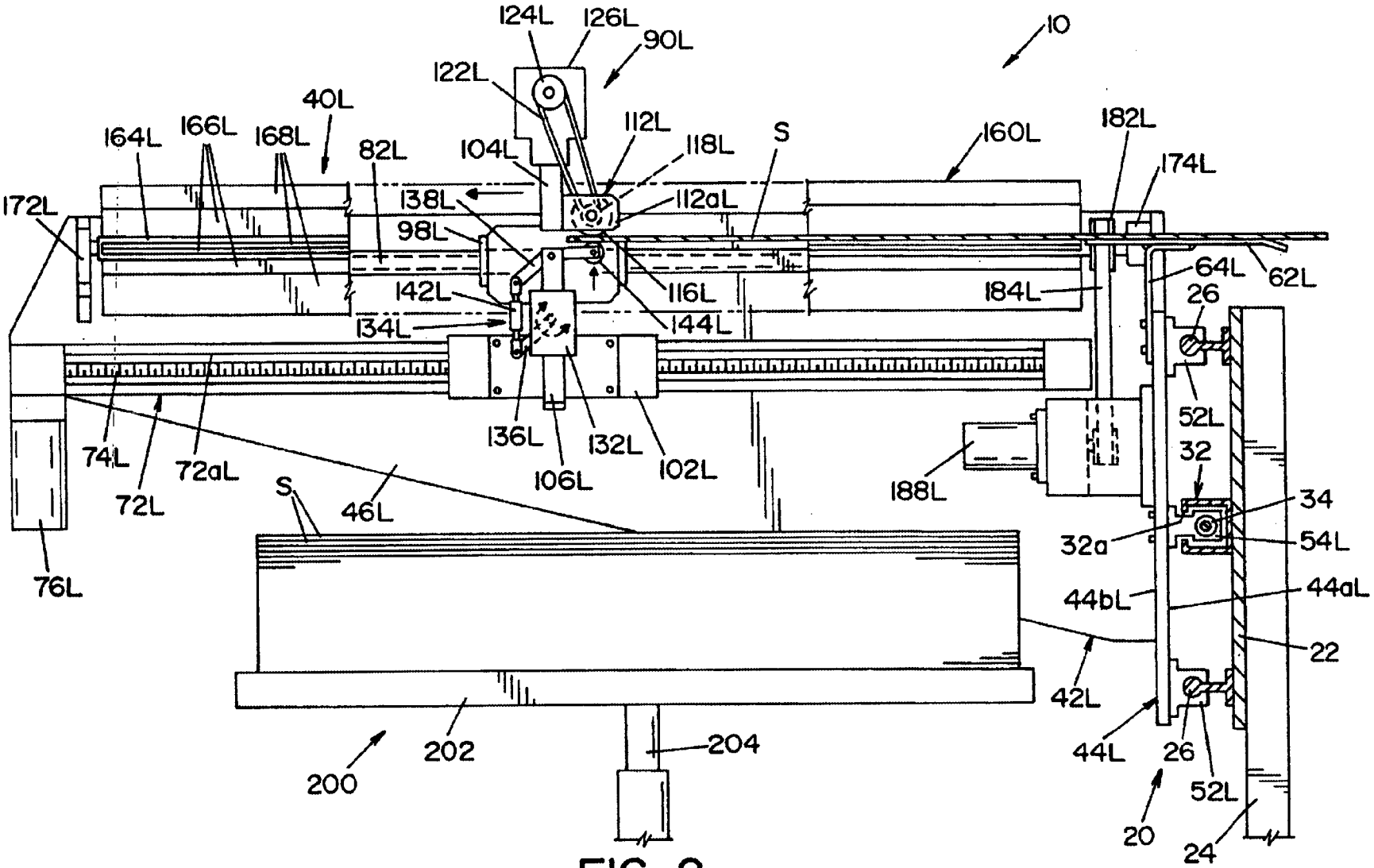
FIG. 2 is a cross-sectional view of the sheet stacking device shown in FIG. 1.
Figure 3:
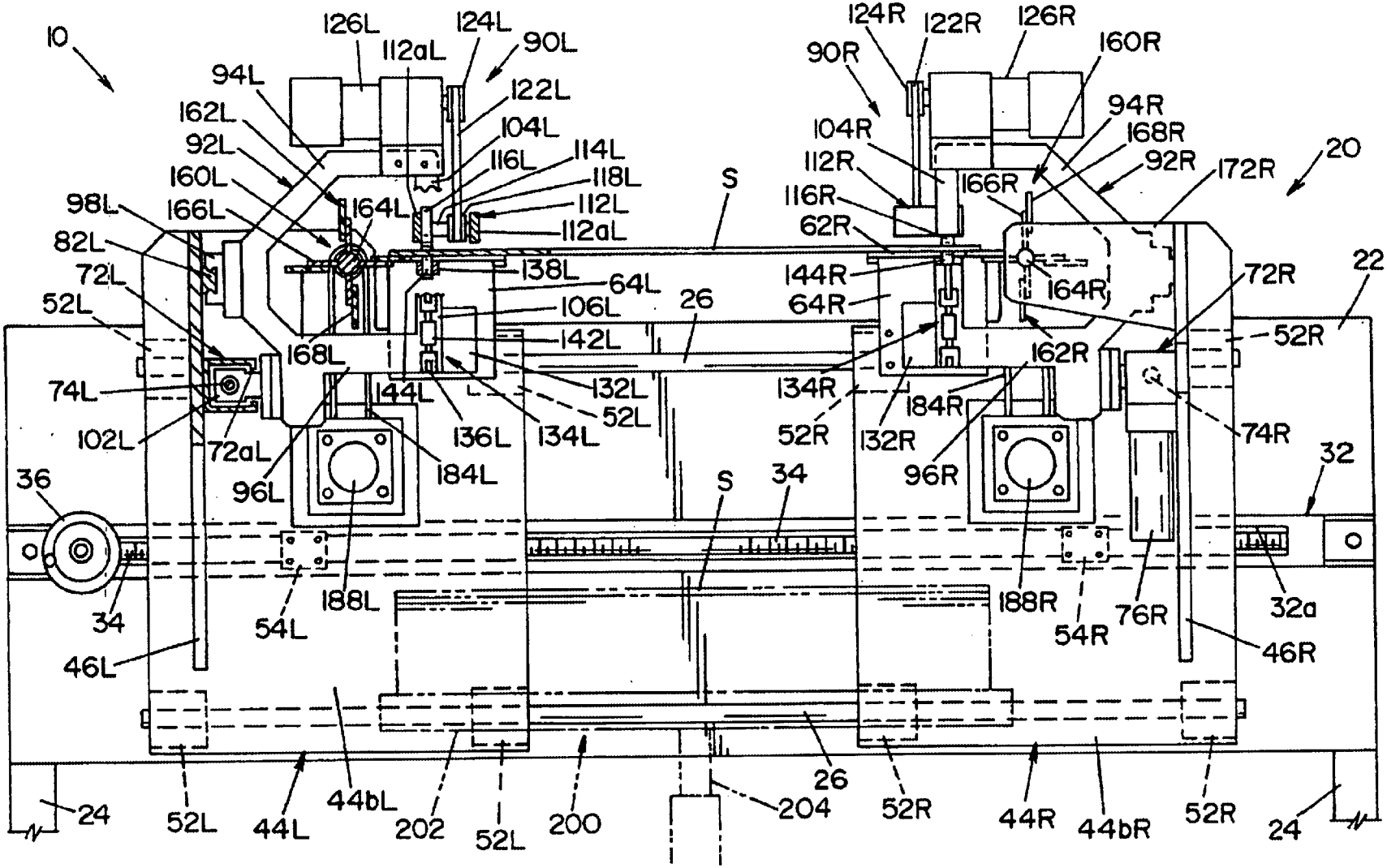
FIG. 3 is an end view, shown partially in section, of the sheet stacking device shown in FIG. 1.

Referring now to the drawings wherein the showings are for the purpose of illustrating the preferred embodiment of the invention only, and not for the purpose of limiting same, FIGS. 1–3 show a sheet stacking device 10 illustrating a preferred embodiment of the present invention. Sheet stacking device 10 is adapted to receive individual sheets, designated S, of a generally planar material at a first position relative thereto, and to stack such sheet onto a vertical stack at a second position. In the embodiment shown, sheet stacking device 10 is basically comprised of a support structure 20, right and left gripper/stacker assemblies 40R, 40L, a stacking assembly 200 and a control assembly 250.

In the embodiment shown, support structure 20 is comprised of a mounting plate 22 that is supported by a pair of spaced-apart vertical posts 24. Posts 24 may be part of an existing machine, or may be separate therefrom and fixedly secured in place by other means. Plate 22 is mounted to posts 24 in a generally vertical orientation. A pair of parallel, spaced-apart rails 26 extend across one face of mounting plate 22. An elongated housing 32 having a slot 32*a* formed therein is disposed between rails 26 in parallel relationship therewith. A lead screw 34 is mounted within housing 32 and extends axially therethrough. A hand wheel 36 and one end of housing 32 is operable to rotate lead screw 34 by conventionally known mechanical means.

Right and left hand gripper/stacker assemblies 40R and 40L are mounted on mounting plate 22 and are spaced apart from each other as shown in the drawings. Right and left gripper/stacker assemblies 40R, 40L are essentially mirror images of each other. Accordingly, only one gripper/stacker assembly 40L shall be described in detail, it being understood that such description applies equally to the other gripper/stacker assembly 40R. In the drawings, like components are designated with like reference numbers, with the suffixes "R" or "L" denoting a component in right (R) gripper/stacker assembly 40R or a component for left (L) gripper/stacker assembly 40L.

Gripper/stacker assembly 40L includes a support frame 42L that is comprised of a generally flat platform 44L and an elongated brace 46L that extends therefrom, as best seen in FIG. 2. Platform 44L is generally a flat plate having a first surface 44*a*L and a second surface 44*b*L. Four (4) slide members 52L are mounted on surface 44*a*L and are disposed to ride upon rails 26, as best seen in FIG. 2. A carriage mount 54L having a threaded opening therethrough is adapted to receive lead screw 34. In this respect, rotation of lead screw 34 by hand wheel 36 causes platform 44L to ride along rails 26. At the upper end of platform 44L, a sheet support 62L is provided. Sheet support 62L is mounted to platform 44L by a bracket 64L, wherein sheet support 62L assumes a generally horizontal orientation.

Referring now to brace 46L, best seen in FIG. 2, an elongated housing 72L having a slot 72*a*L therein extends along the surface of brace 46L. A gripper lead screw 74L is mounted axially within housing 72L. A motor 76L is mounted at the free end of brace 46L and is connected to one end of lead screw 74L by conventional means (not shown). Motor 76L is operable to turn lead screw 74L. Motor 76L is preferably a stepper motor, having means for sensing the angular position thereof.

An elongated track 82L, best seen in FIGS. 1 and 3, extends along brace 46L above, and parallel to, lead screw 74L. Track 82L, together with lead screw 74L, is adapted to support a gripper mechanism 90L, best seen in FIG. 3. Gripper mechanism 90L includes a gripper carriage 92L having an upper arm 94L, and a lower arm 96L. A slide member 98L, mounted on carriage 92L is dimensioned to receive track 82L and slide therealong. Carriage 92L also includes a lead screw mount 102L having an opening therein dimensioned to operatively receive lead screw 74L, wherein rotation of lead screw 74L causes gripper carriage 92L to move along track 82L.

Upper arm 94L includes a downwardly extending post 104L, and lower arm 96L includes an upwardly extending post 106L, as best seen in FIG. 2. Posts 104L, 106L are generally aligned with each other. The facing ends of posts 104L, 106L are spaced apart to form a gap therebetween. Mounted to post 104L is a generally C-shaped bracket 112L that has spaced-apart leg portions 112*a*L between which extends a pin 114L. An upper friction roller 116L and a pulley 118L are fixedly mounted on pin 114L, as best seen in FIG. 3. Pulley 118L is adapted to receive a drive belt 122L. Drive belt 122L is operatively attached to a pulley 124L that is mounted on a shaft of a motor 126L. Motor 126L is operable to drive belt 122L to rotate friction roller 116L.

Referring now to post 106L on lower arm 96L, a rotary actuator 132L is mounted thereto. Actuator 132L is connected to a linkage 134L. Linkage 134L is comprised of a first lever arm 136L, a second lever arm 138L, and a connecting rod 142L. First lever arm 136L is pivotally connected to actuator 132L. A lower friction roller 144L is rotatably mounted at the free end of second lever arm 138L. Lower friction roller 144L is disposed to be in alignment with upper friction roller 116L. Linkage 134L is operable to move lower friction roller 144L towards, and away from, upper friction roller 116L upon actuation of rotary actuator 132L.

Referring now to stacking mechanism 160L, lateral support for a sheet S is provided by a rotary element 162L, as best seen in FIG. 3. Rotary element 162L is comprised of an elongated shaft 164L having a plurality of outwardly extending, angularly, spaced-apart fins 166L. In the embodiment shown, four (4) radially extending, equally spaced fins 166L are shown. Shaft 164L and fins 166L are preferably formed of a metal or a rigid plastic. Guide strips 168L are mounted on one side of each fin 166L, as best seen in FIG. 3. Shaft 164L is supported at one end by a bracket 172L that extends from brace 46L, and at the other end by an annular bracket 174L, mounted to platform 44L. Shaft 164L is mounted to be generally parallel to track 82L, and such that an exposed surface on a strip 168L can be positioned to be coplanar with the surface of sheet support 62L, as best seen in FIG. 2.

A pulley 182L is mounted to shaft 164L adjacent to annular bracket 174L, as best seen in FIG. 2. A drive belt 184L is mounted on pulley 182L. Belt 184L is mounted to a pulley (not shown) mounted on a shaft of a motor 188L. Motor 188L is mounted on platform 44L and is operable to drive belt 184L, and in turn, to rotate shaft 164L. Like motor 126L, motor 188L is preferably a stepper motor, wherein the annular position of shaft 164L may be accurately determined and controlled.

Stacking assembly 200 is disposed below and between right gripper/stacker assembly 40R and left gripper/stacker assembly 40L. Stacking assembly 200 is generally comprised of a stacking platform 202 supported by a movable support. In the embodiment shown, stacking platform 202 is supported on a rod 204 that extends from a base (not shown). Stacking platform 202 is preferably operable to move downward a predetermined distance each time a sheet S is stacked thereon. In this respect, stacking platform 202 may be supported by a compression spring (not shown), wherein stacking platform 202 is lowered as the weight thereon increases. Alternately, rod 204 may be comprised of a conventional, hydraulic or pneumatic cylinder, or mechanical screw device, that is operably controlled to lower a stacking platform 202 after a predetermined number of sheets have been stacked thereon.

Figure 4:
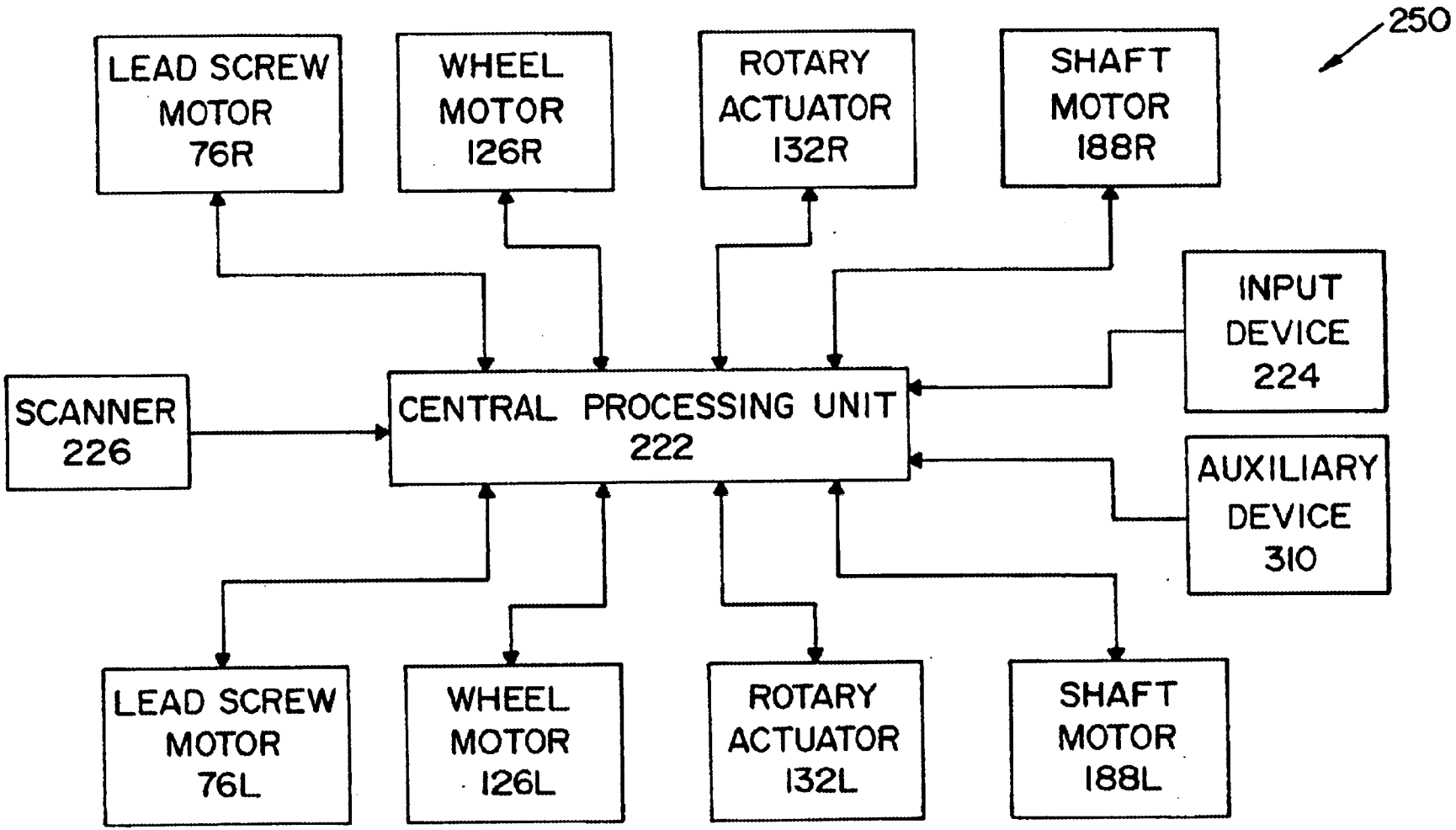
FIG. 4 is a block diagrammatic representation of the control system for the sheet stacking device shown in FIG. 1.

Referring now to FIG. 4, a block diagrammatic representation of a control system 250 for sheet stacking device 10 is shown. The physical operation of sheet stacking device 10 is basically controlled by a central processing unit 222 which is programmed to control operations of the various components of sheet stacking device 10 by means of a program stored therein. Central processing unit 222 is operably connected to lead screw drive motors 76R, 76L, friction wheel drive motors 126R, 126L, rotary actuators 132R, 132L and shaft drive motors 188R, 188L. In this respect, central processing unit 222 controls the operation of such components, and at the same time, receives information back from such components as to their relative positions. In this respect, as indicated above, the aforementioned motors preferably include position-sensing means to provide an indication of their relative positions of the shaft of such motors, which, in turn, provides central processing unit 222 with an indication of the relative positions of the associated components.

In addition to the foregoing, an input device 224, such as a key pad, mouse or touch-screen panel, is provided to allow users to re-program central processing unit 222 to modify operations of sheet stacking device 10, as shall be described in greater detail below. Further, a scanner 226, shown in FIG. 5G, may be used to detect and monitor the quality of the sheets to be stacked and to provide a signal to central processing unit 222 identifying defective sheets that should be discarded from the stack. Still further, central processing unit 222 may receive signals from an auxiliary device, such as a sheet feeder or cutting device 310 to provide an indication as to the operation thereof.

Referring now to FIGS. 5A–5G, sheet stacking device 10 shall further be described with respect to its operation. In FIGS. 5A–5F, sheet stacking device 10 is shown together with a sheet cutting device 310 that is operable to cut a generally continuous length of material M into sheets S of a desired length. Sheet cutting device 310, in and of itself, forms no part of the present invention, and is shown solely for the purpose of illustration. Sheet cutting device 310 merely represents a source of "cut-to-length sheets" S to be stacked. It will be appreciated from a further reading of the specification, that sheets S need not be cut from a continuous roll, but may be formed in a flat, planar configuration by any suitable process.

In the particular embodiment shown, material M to be cut into sheets S is guided along a predetermined path by guide rollers 312. A cutting assembly 314 is provided along the path to cut material M into sheets S of predetermined lengths. In the embodiment shown, cutting assembly 314 is comprised of a movable, upper cutting die 316 and a stationery lower cutting die 318. Cutting assembly 314 is operable to repeatedly shear like-sized sheets S from material M and to provide individual sheets S to stacking device 10 at the aforementioned first position.

Figure 5A:
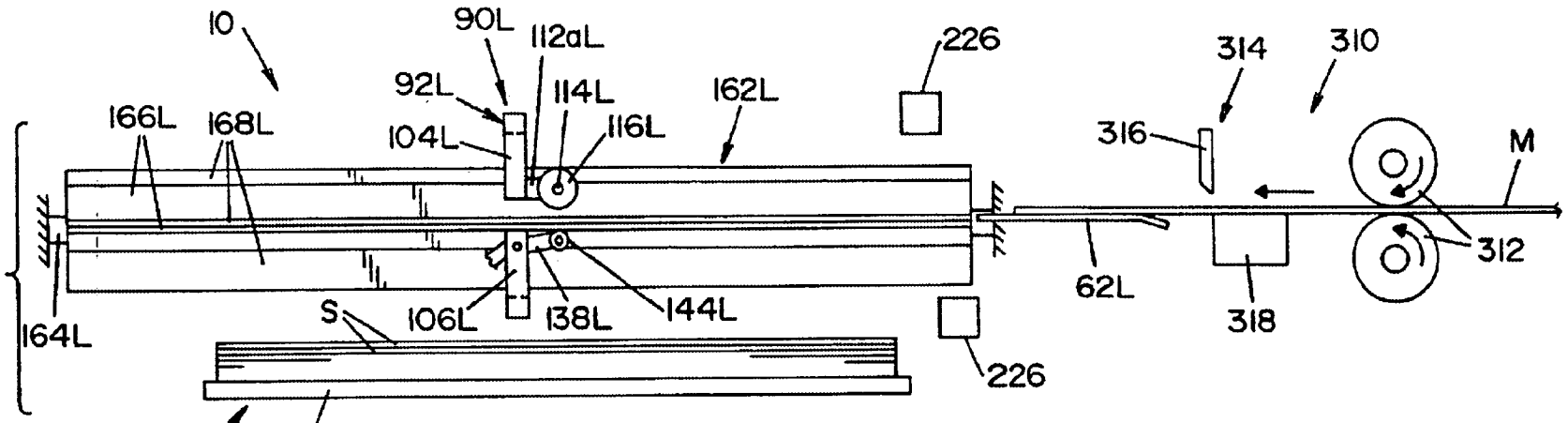
FIGS. 5A–5F are schematic, side elevational views of the sheet stacking device shown in FIG. 1, illustrating a sequence for stacking a sheet.
Figure 5B:
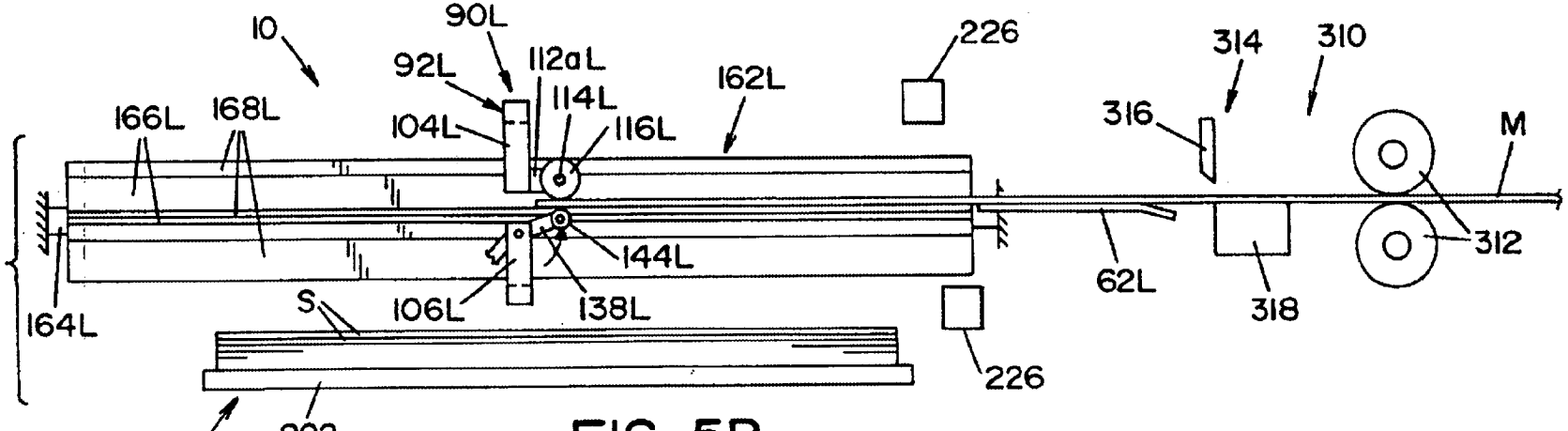
Figure 5C:
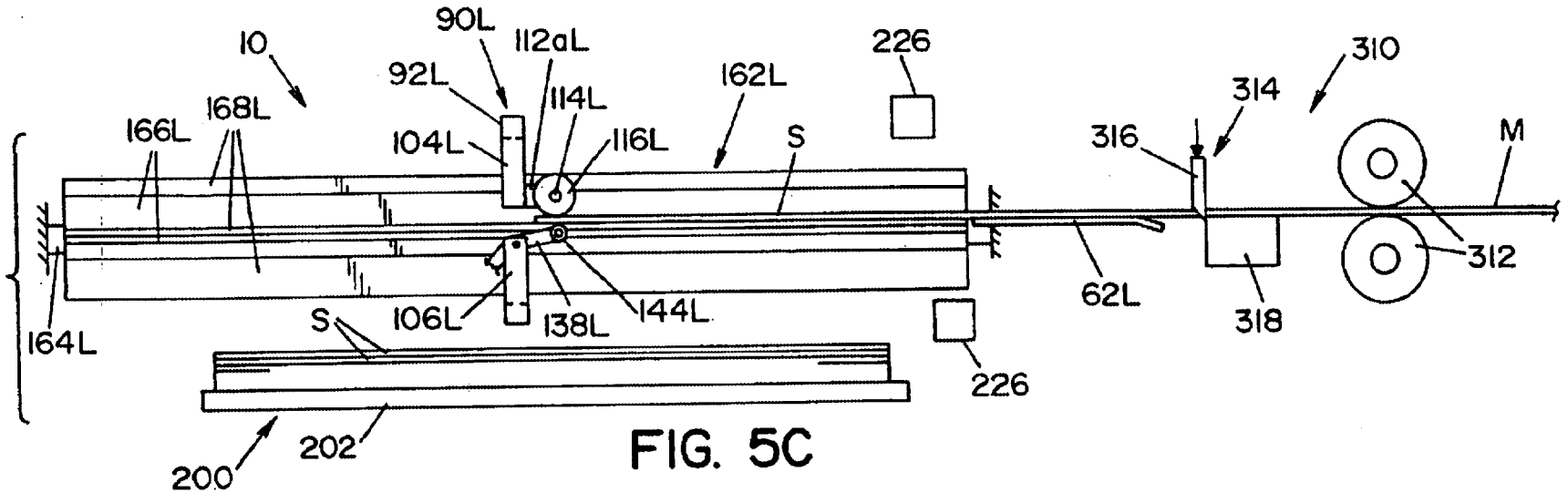

In this respect, FIG. 5A shows material M being conveyed through guide rollers 312 and through cutting assembly 314. Sheet stacking device 10 is oriented such that sheet supports 62R, 62L provide support for material M as it passes through cutting assembly 314. Glide strips 168R, 168L on fins 166R, 166L of rotary elements 162R, 162L are disposed to provide support to the lateral edges of material M as it moves into stacking device 10. FIG. 3 best illustrates material M being supported by glide strips 168R, 168L of right and left gripper/stacking assemblies 40R, 40L. Pinch rollers 312 cause material M to be conveyed to a position as illustrated in FIG. 5C. Gripper mechanisms 90R, 90L are initially in a first position as shown in FIG. 5A with linkage 134R, 134L in a first position wherein lower friction rollers 144R, 144L are disposed away from upper friction rollers 116R, 116L. The free end of material M is thus allowed to pass between friction rollers 116R, 116L and 144R, 144L. In this respect, the initial position of gripper mechanisms 90R, 90L is established by central processing unit 222 by controlling motors 76R, 76L which turns lead screws 74R, 74L and moves gripper mechanisms 90R, 90L to a predetermined position. In this respect, gripper mechanisms 90R and 90L are moved together by central processing unit 222 to side-by-side positions, as schematically illustrated in FIG. 5A. When material M has reached a predetermined length relative to cutting assembly 314, rotary actuators 132R, 132L are energized by central processing unit 222 to cause linkage 134R, 134L to move second lever arms 138R, 138L to a second position, wherein lower friction rollers 144R, 144L press sheet material M against upper friction rollers 116R, 116L, as schematically illustrated in FIG. 5B. As will be appreciated, central processing unit 222 actuates rotary actuators 132R, 132L on both gripper mechanisms 90R and 90L. With material M supported along its lateral edges by glide strips 168R, 168L on rotary elements 162R, 162L, and with the leading edge of material M pinched between friction rollers 116R, 116L and 144R, 144L, cutting assembly 314 is energized, wherein upper cutting die 316 shears through material M severing it into a sheet S, as illustrated in FIG. 5C.

Figure 5D:
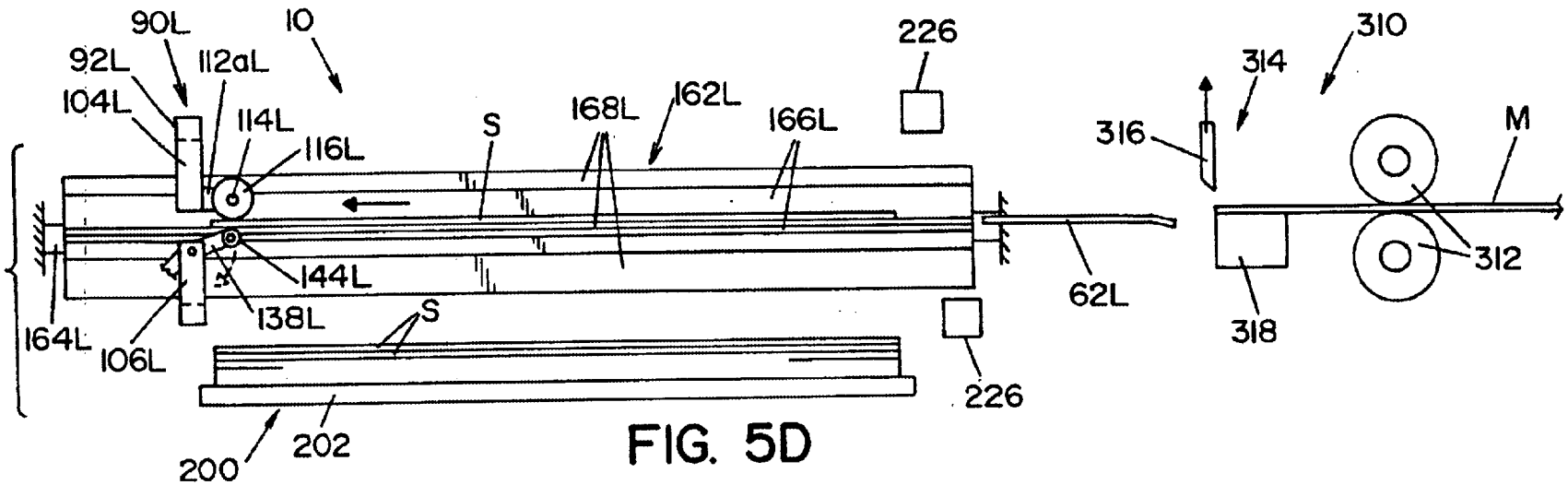
Figure 5E:
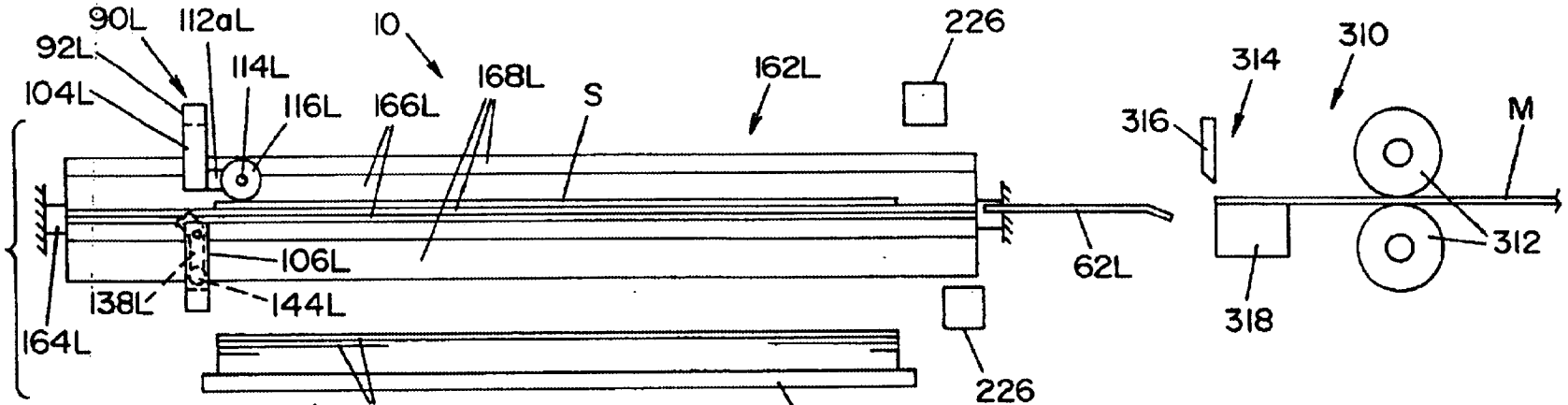
Figure 5F:
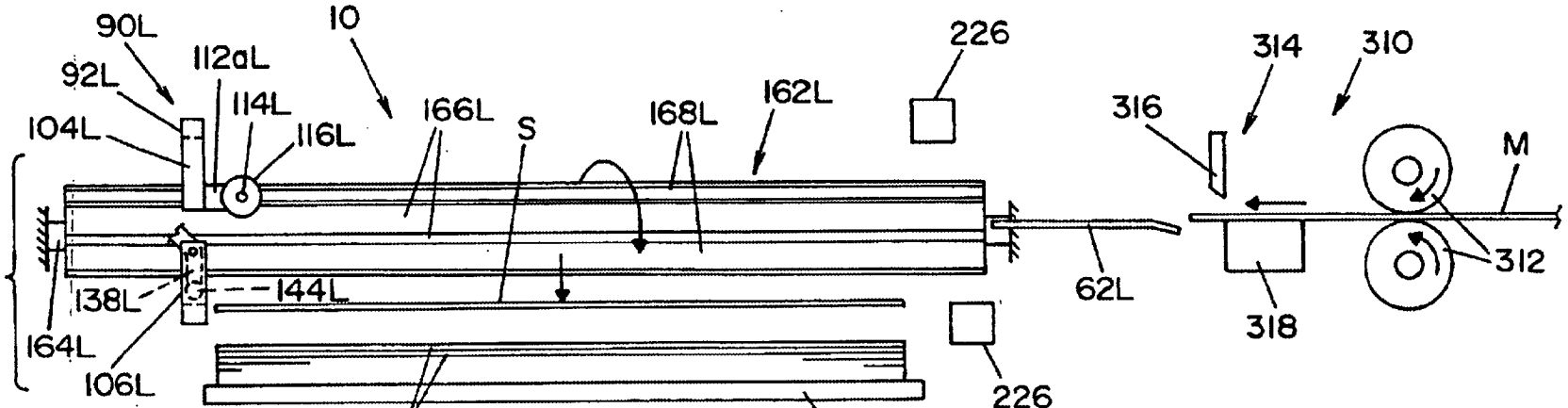

With sheet S severed from the generally continuous length of material M, central processing unit 222 causes gripper motors 76R and 76L to rotate lead screws 74R, 74L, to cause gripper mechanisms 90R, 90L to move away from cutting assembly 314, wherein sheet S is slid along glide strips 168R, 168L of rotary elements 162R, 162L. As illustrated in FIG. 5D, sheet S is slid along to a position over stacking platform 202. When sheet S reaches a predetermined position relative to platform 202, as determined by central processing unit 222 by monitoring the position of gripper mechanisms 90R, 90L, rotary actuators 132R, 132L are energized by central processing unit 222 to cause linkage 134R, 134L to move to its first position, wherein lower friction rollers 144R, 144L move away from upper friction rollers 116R, 116L, thereby releasing the edge of sheet S. Sheet S is thus released in a position above stacking platform 202. Central processing unit 222 causes stacker motors 188R, 188L to rotate rotary elements 162R, 162L ninety degrees (90°). In the embodiment shown, rotary element 162R is rotated in a counter clockwise direction and rotary element 162L is rotated in a clockwise direction. As a result of the rotation of rotary elements 162R, 162L, support for the edges of sheet S is removed, and sheet S is allowed to fall onto a stack on platform 202. Rotation of rotary elements 162R and 162L by ninety degree (90°) positions another pair of glide strips 168R, 168L in horizontal relationship relative to each other to define a plane for supporting material M and a sheet S. Central processing unit 222 then causes gripper motors 76R, 76L to turn lead screws 74R, 74L in a direction to cause gripper mechanisms 90R, 90L to return to an initial position, as shown in FIGS. 5A, 5B, to receive the next sheet S to be cut from material M.

Figure 5G:
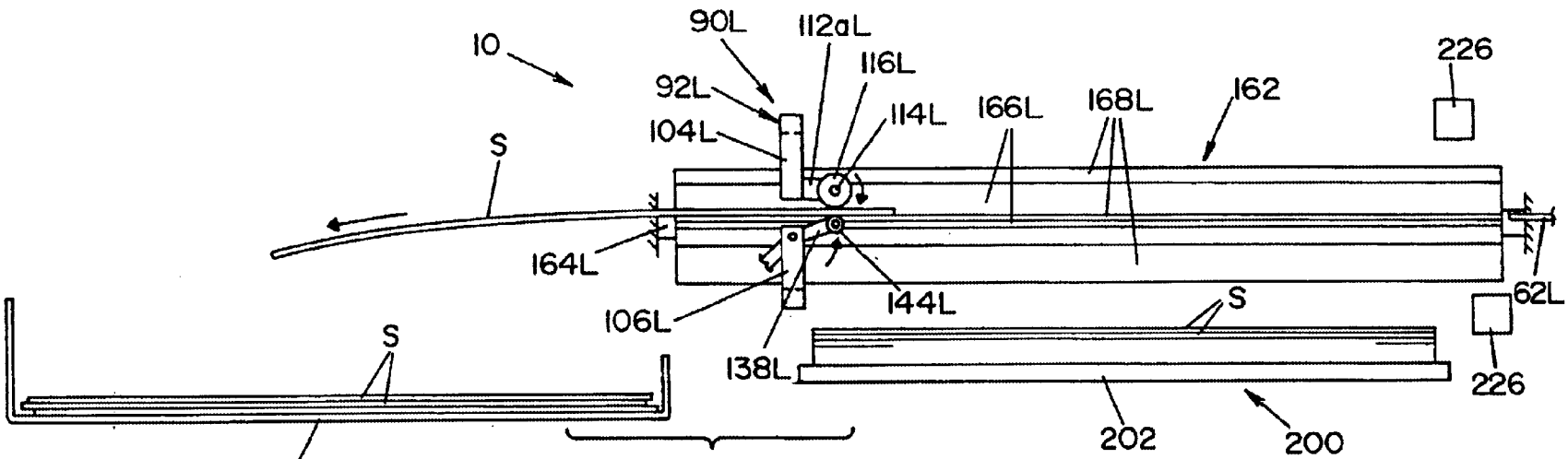
FIG. 5G is a schematic, side elevational view of the sheet stacking device shown in FIG. 1 showing a sheet diverting operation.

Referring now to FIG. 5G, an operation for diverting sheets S from stacking platform 202 is illustrated. In some instances, it may be desirable not to stack a certain sheet S for some reason, such as by way of example and not limitation, a defect. In FIG. 5G, scanners 226 are schematically illustrated and disposed above and below the path along which material M and sheet S will pass. Such scanners may be used to detect defects or imperfections in sheet S. In the event that a defect is detected, stacking device 10 is operable to divert such sheet to a divert bin, designated 372. In this respect, the divert operation is essentially similar to the operation heretofore described and shown in FIGS. 5A–5D. However, instead of gripper mechanisms 90R, 90L releasing the edge of sheet S above platform 202, gripper mechanisms 90R, 90L pull sheet S to the end of stacking device 10. Central processing unit 222 causes motors 126R, 126L to rotate upper friction rollers 116R, 116L so as to drive sheet S from sheet stacking device, as schematically illustrated in FIG. 5G. Specifically, in the embodiment shown, motors 126R, 126L cause belts 122R, 122L to rotate friction rollers 116R, 116L in a clockwise direction. The defective or undesirable sheet is thus ejected to a divert bin 372 by friction rollers 116R, 116L. Gripper mechanisms 90R, 90L are returned to their initial positions, as shown in FIG. 5A to receive the next sheet S to be cut from material M.

Figure 6A:
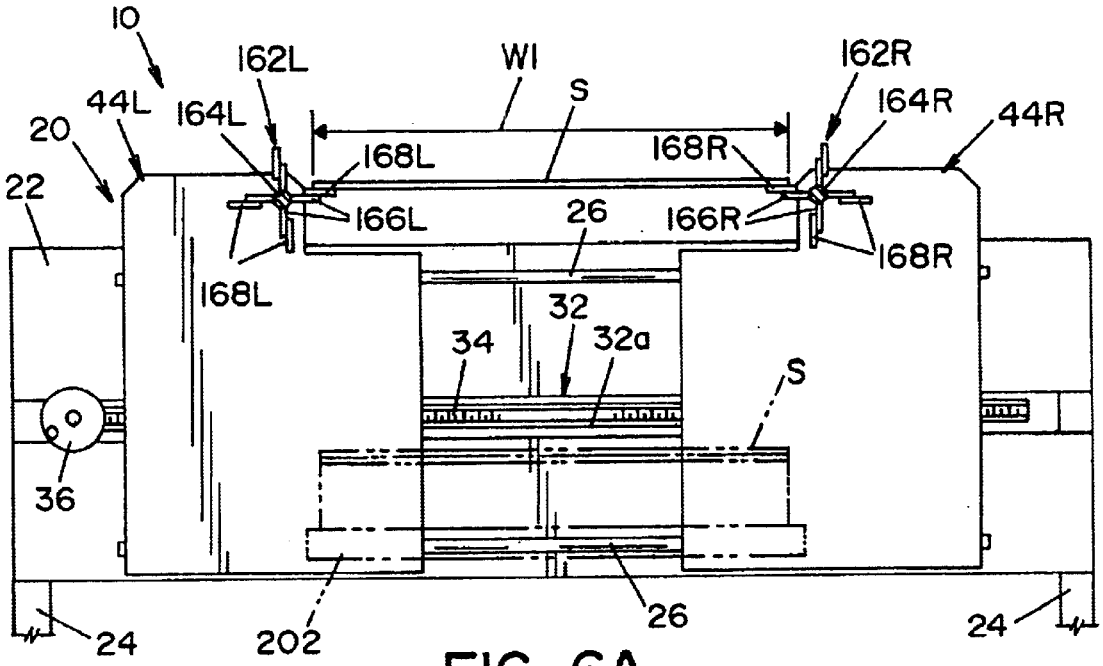
FIGS. 6A and 6B are end views illustrating an adjustment of the sheet stacking device shown in FIG. 1 that allows for handling sheets of various widths.
Figure 6B:
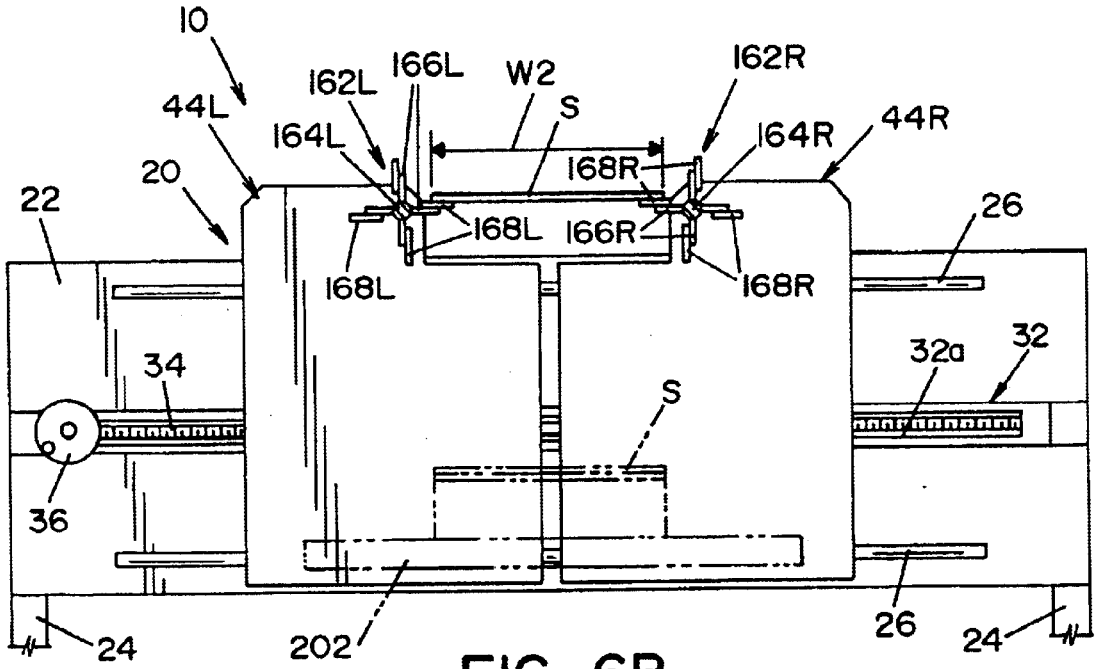

Referring now to FIGS. 6A and 6B, a method of adjusting sheet stacking device 10 to accommodate material M of different widths is shown. FIG. 6A shows right and left gripper/stacker assemblies 40R, 40L in a spaced-apart position to accommodate a sheet having a width W1. Sheet S is shown supported on glide strips 168R, 168L of rotary elements 162R, 162L above stacking platform 202 (shown in phantom). The relative positions of gripper/stacker assemblies 40R, 40L may be adjusted to accommodate a sheet having a width W2, as shown in FIG. 6B, by using hand wheel 36 to rotate lead screw 34. Carriage mounts 54R, 54L on platform 42R, 42L, respectively, are operable to cause the same to move in opposite directions upon rotation of lead screw 34 in a manner as is conventionally known. Thus, rotating hand wheel 36 in a predetermined direction, will cause right and left gripper/stacker assemblies 40R, 40L to accommodate material M and sheet S of desired width.

As will also be appreciated, the operation of sheet stacking device 10 may be adjusted to stack longer or shorter sheets by merely reprogramming central processing unit 222 to change the initial position, travel distance and release point of gripper mechanisms 90R, 90L.

The present invention thus provides a sheet stacking device 10 operable to accommodate sheet material of differing lengths and widths, and a sheet stacking device 10 that is able to automatically stack sheet material at a predetermined location and automatically divert undesirable sheets from the stacking location.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A sheet stacking device for stacking sheets, comprised of:

at least one gripper device movable along a track operable to releasably grip a leading edge of a sheet material in a direction of motion;

gripper drive means operable to move said gripper device from a first location to a second location;

two spaced-apart support devices supporting said sheet as said sheet moves from said first location to said second location, said support devices having a supporting position, wherein said support device supports said sheet and a non-supporting position wherein support for said sheet is removed;

a stacking platform below said second location; and control means for controlling said gripper device, said gripper drive means and said support device, wherein said control means causes 1) said gripper device to grip a leading edge of said sheet at said first location, 2) said drive means to move said gripper device along said track from said first location to said second location, 3) said gripper device to release said leading edge of said sheet at said second location, and 4) said support device to move from said supporting position to said non-supporting position, dropping said sheet onto said stacking platform.

2. A sheet stacking device as defined in claim 1, wherein said sheet stacking device includes two, spaced-apart gripper devices.

3. A sheet stacking device as defined in claim 2, wherein each of said gripper devices includes spaced-apart friction rollers, one of said friction roller operable to move toward the other to grip a sheet material therebetween, and one of said friction rollers being rotatable by a motor for conveying a sheet material through said rollers.

4. A sheet stacking device as defined in claim 1, wherein each of said support devices is comprised of an elongated shaft rotatable along its axis having a plurality of outwardly extending support surfaces, said support devices being disposed relative to each other, wherein one support surface from each of said support devices is positionable to be in planar alignment with the other, said support devices being spaced apart such that each of said one support surface from each of said support devices supports an edge of said sheet.

5. A sheet stacking device as defined in claim 4, wherein each of said support devices is a mirror image of the other.

6. A sheet stacking device as defined in claim 5, wherein each of said two support devices supports a lateral edge of said sheet in said direction of motion.

7. A sheet stacking device for stacking sheets, comprised of:

two, spaced-apart gripper devices, each of said gripper devices being operable to releasably grip an edge of a sheet material, each of said gripper devices including spaced-apart friction rollers, one of said friction roller operable to move toward the other to grip a sheet material therebetween, and one of said friction rollers being rotatable by a motor for conveying a sheet material through said rollers, and each of said gripper devices being a mirror image of the other;

gripper drive means operable to move said gripper device from a first location to a second location;

two spaced-apart support devices supporting said sheet as said sheet moves from said first location to said second location, said support devices each having a supporting position, wherein said support devices support said sheet and a non-supporting position wherein support for said sheet is removed;

a stacking platform below said second location; and control means for controlling said gripper device, said gripper drive means and said support device, wherein said control means causes 1) said gripper devices to arm an edge of said sheet at said first location, 2) said drive means to move said gripper devices from said first location to said second location, 3) said gripper devices to release said sheet at said second location, and 4) said support device to move from said supporting position to said non-supporting position, dropping said sheet onto said stacking platform.

8. A sheet stacking device as defined in claim 7, wherein each of said gripper devices is adapted to grip a leading edge of said sheet in a direction of motion.

9. A sheet stacking device for stacking sheets, comprised of:

at least one gripper device operable to releasably grip an edge of a sheet material;

gripper drive means operable to move said gripper device from a first location to a second location;

a support device supporting said sheet as said sheet moves from said first location to said second location, said support device having a supporting position, wherein said support device supports said sheet and a non-supporting position wherein support for said sheet is removed, each of said support devices being a mirror image of the other, and being comprised of an elongated shaft rotatable alone its axis having a plurality of outwardly extending support surfaces, said support devices being disposed relative to each other, wherein one support surface from each of said support devices is positionable to be in planar alignment with the other, said support devices being spaced apart such that each of said one support surface from each of said support devices supports a lateral edge of said sheet in said direction of motion, the distance between said support devices being adjustable;

a stacking platform below said second location; and control means for controlling said gripper device, said gripper drive means and said support device, wherein said control means causes 1) said gripper device to grip an edge of said sheet at said first location, 2) said drive means to move said gripper device from said first location to said second location, 3) said gripper device to release said sheet at said second location, and 4) said support device to move from said supporting position to said non-supporting position, dropping said sheet onto said stacking platform.

10. A sheet stacking device for stacking sheets, comprised of:

at least one gripper device operable to releasably grip an edge of a sheet material;

gripper drive means operable to move said gripper device from a first location to a second location;

a support device supporting said sheet as said sheet moves from said first location to said second location, said support device having a supporting position, wherein said support device supports said sheet and a non-supporting position wherein support for said sheet is removed;

a stacking platform below said second location;

control means for controlling said gripper device, said gripper drive means and said support device, wherein said control means causes 1) said gripper device to grip an edge of said sheet at said first location, 2) said drive means to move said gripper device from said first location to said second location, 3) said gripper device to release said sheet at said second location, and 4) said support device to move from said supporting position to said non-supporting position, dropping said sheet onto said stacking platform; and divert means for conveying a sheet from said second location to a third location.

11. A sheet stacking device as defined in claim 10, wherein said divert means are associated with said gripper device.

* * * * *